US008240811B2

(12) United States Patent
Sakano

(10) Patent No.: US 8,240,811 B2
(45) Date of Patent: Aug. 14, 2012

(54) INK-JET RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 323 days.

(21) Appl. No.: 12/748,086

(22) Filed: Mar. 26, 2010

(65) Prior Publication Data

US 2010/0245421 A1 Sep. 30, 2010

(30) Foreign Application Priority Data

Mar. 26, 2009 (JP) ..... 2009-075945

(51) Int. Cl.
*B41J 2/165* (2006.01)

(52) U.S. Cl. ..... 347/35
(58) Field of Classification Search ..... 347/35
See application file for complete search history.

(56) References Cited

U.S. PATENT DOCUMENTS 5,055,861 A 10/1991 Murayama et al.

FOREIGN PATENT DOCUMENTS

JP 2733275 B2 3/1998

*Primary Examiner* — Julian Huffman
(74) *Attorney, Agent, or Firm* — Baker Botts L.L.P.

(57) ABSTRACT

An ink-jet recording apparatus including: an ink-jet head; a feeding mechanism which includes a feeding member having a feeding surface and which is configured to feed a sheet on the feeding surface in a feeding direction; a supplying mechanism which supplies the sheet to the feeding mechanism; and a controller which controls operations of the ink-jet head, the feeding mechanism, and the supplying mechanism, wherein the controller is configured to perform a first control in which the ink is ejected directly onto the feeding surface and a second control in which the sheet is, after the first control, supplied from the supplying mechanism to the feeding mechanism such that the sheet absorbs the ink on the feeding surface that has been ejected from the ink-jet head in the first control, and in which the sheet is fed by the feeding mechanism during the ejection of the ink.

12 Claims, 7 Drawing Sheets

MAIN SCANNING DIRECTION
SUB-SCANNING DIRECTION

INK-JET RECORDING APPARATUS

CROSS REFERENCE TO RELATED APPLICATION

The present application claims priority from Japanese Patent Application No. 2009-075945, which was filed on Mar. 26, 2009, the disclosure of which is herein incorporated by reference in its entirety.

BACKGROUND OF THE INVENTION

1. Field of the Invention

The present invention relates to an ink-jet recording apparatus configured to perform recording on a recording medium.

2. Description of the Related Art

An ink-jet recording apparatus generally includes (a) a sheet-feed mechanism configured to feed a recording medium such as a paper sheet and (b) ink-jet heads configured to eject ink onto the recording medium fed by the sheet-feed mechanism. This ink-jet recording apparatus performs what is called a flushing in which the ink is ejected from the ink-jet heads at regular intervals such that the ink does not dry in the ink-jet heads.

In a conventional technique, the flushing is performed onto the sheet-feed belt, and then a surface of the sheet-feed belt to which the ink has adhered is cleaned by a cleaner.

SUMMARY OF THE INVENTION

However, in the case where the flushing is performed on the sheet-feed belt, there occurs a problem that a cleaning mechanism for cleaning the sheet-feed belt is needed, which leads to a higher cost and a larger size of the apparatus.

This invention has been developed in view of the above-described situations, and it is an object of the present invention to provide an ink-jet recording apparatus capable of performing a flushing with a relatively low cost and a relatively small space.

The object indicated above may be achieved according to the present invention which provides an ink-jet recording apparatus comprising: at least one ink-jet head having an ink-ejection surface from which an ink is ejected; a feeding mechanism which includes a feeding member having a feeding surface facing the ink-ejection surface and which is configured to feed a recording medium on the feeding surface in a feeding direction in which the recording medium is fed; a supplying mechanism configured to supply the recording medium to the feeding mechanism; and a controller configured to control operations of the at least one ink-jet head, the feeding mechanism, and the supplying mechanism, wherein the controller is configured to perform (i) a first control in which the ink is ejected directly onto the feeding surface and (ii) a second control in which the recording medium is, after the first control, supplied from the supplying mechanism to the feeding mechanism such that the recording medium absorbs the ink on the feeding surface that has been ejected from the at least one ink-jet head in the first control, and in which the recording medium is fed by the feeding mechanism during the ejection of the ink from the at least one ink-jet head onto the recording medium.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DESCRIPTION OF THE EMBODIMENTS

Hereinafter, there will be described embodiments of the present invention by reference to the drawings.

<First Embodiment>

[Mechanical Construction of Ink-Jet Printer]

Figure 1:
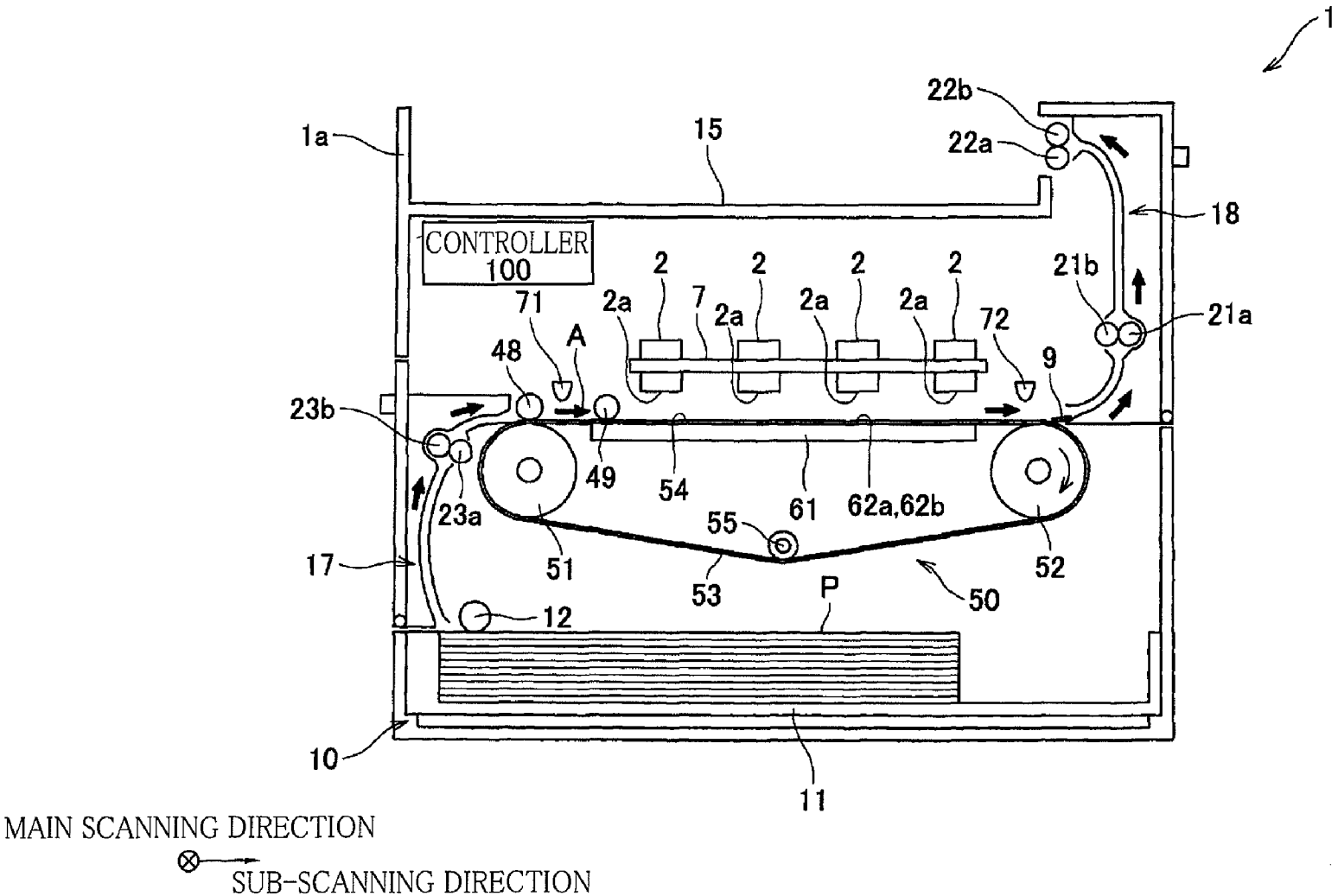
FIG. 1 is a side view generally showing an internal structure of an ink-jet printer as a first embodiment of the present invention.

As shown in FIG. 1, an ink-jet printer (i.e., an ink-jet recording apparatus) 1 as a first embodiment of the present invention is a color ink-jet printer including (a) a casing 1*a* having a rectangular parallelepiped shape and (b) four ink-jet heads 2 disposed in the casing 1*a* and configured to respectively eject inks of four colors, namely, magenta, cyan, yellow, and black. In this ink-jet printer 1, a sheet-supply device 10 as a supplying mechanism is disposed in a lower portion of the printer 1 in FIG. 1 while a sheet-discharge portion 15 is disposed in an upper portion of the printer 1 in FIG. 1. Between the sheet-supply device 10 and the sheet-discharge portion 15 is provided a sheet-feed mechanism 50 as a feeding mechanism which feeds a recording medium in the form of a sheet P in a sheet-feed direction A as a feeding direction. Further, the ink-jet printer 1 includes a controller 100 configured to control these operations.

Each of the four ink jet heads 2 has a generally rectangular parallelepiped shape elongated in a main scanning direction. The four ink-jet heads 2 are fixed to a frame 7 and arranged so as to be adjacent to each other in a sub-scanning direction. That is, this printer 1 is a printer of line type. It is noted that, in the present embodiment, the sub-scanning direction is a direction parallel to the sheet-feed direction A while the main scanning direction is a direction perpendicular to the sub-scanning direction and parallel to a horizontal surface (i.e., a direction perpendicular to a sheet surface of FIG. 1).

Each of the ink-jet heads 2 includes a stacked body, not shown, constituted by adhering (a) a channel unit in which are formed ink channels respectively having pressure chambers and (b) actuators which respectively apply pressures to the ink in the pressure chambers. A bottom surface of each ink-jet head 2 functions as an ink-ejection surface 2*a* from which the ink is ejected. A plurality of ink-ejection openings through which the ink is ejected are formed in each ink-ejection surface 2*a*.

The sheet-supply device 10 includes (a) a sheet-supply cassette 11 capable of accommodating a plurality of the sheets P in a state in which the sheets P are stacked on each other, (b) a sheet-supply roller 12 which supplies each sheet P from the sheet-supply cassette 11, and (c) a sheet-supply motor, not shown, which rotates the sheet-supply roller 12. The sheet-supply cassette 11 is disposed so as to be inserted and removed in the direction perpendicular to the sheet surface of FIG. 1. When mounted on the casing 1*a*, the sheet-supply cassette 11 is disposed at a position overlapping with the sheet-feed mechanism 50 in an upward and downward direction in FIG. 1. The sheet-supply roller 12 contacts an uppermost one of the sheets P while rotating, and thereby supplies the uppermost sheet P from the sheet-supply cassette 11. It is noted that the sheet-supply motor which rotates the sheet-supply roller 12 is controlled by the controller 100.

Between the sheet-supply cassette 11 and the sheet-feed mechanism 50 along a sheet-feed path in a left end portion of the printer 1 in FIG. 1, there are disposed (a) a sheet-supply guide 17 curving and extending from the sheet-supply cassette 11 to the sheet-feed mechanism 50 and (b) two sheet-feed rollers 23*a*, 23*b* disposed on a downstream portion of the sheet-supply guide 17. The sheet-feed roller 23*b* is driven to be rotated by a sheet-feed motor, not shown, controlled by the controller 100. Further, the sheet-feed roller 23*a* is a driven roller rotated with the feeding of the sheet P.

In this structure, the controller 100 controls the sheet-supply roller 12 such that the roller 12 rotates in a clockwise direction in FIG. 1, whereby the sheet P contacting the sheet-supply roller 12 is fed through the sheet-supply guide 17 toward an upper portion of the printer 1 in FIG. 1. Then, the sheet P is supplied to the sheet-feed mechanism 50 while being nipped by the sheet-feed rollers 23*a*, 23*b*.

The sheet-feed mechanism 50 includes (a) two belt rollers 51, 52, (b) an endless sheet-feed belt 53 as a feeding member wound around the two belt rollers 51, 52 so as to bridge the belt rollers 51, 52, (c) a tension roller 55 which applies tension to the sheet-feed belt 53, (d) a sheet-feed motor, not shown, which rotates the belt roller 52, and (e) a platen 61 having a generally rectangular parallelepiped shape. The two belt rollers 51, 52 are disposed side by side in the sheet-feed direction A. The sheet-feed belt 53 has a sheet-feed surface 54 as a feeding surface on which the sheet P is placed upon feeding of the sheet P. More specifically, a part of an entire outer surface of the sheet-feed belt 53, which part faces the ink-ejection surface 2*a* and is supporting the sheet P thereon functions as the sheet-feed surface 54.

The belt roller 52 is a drive roller rotated by the sheet-feed motor, not shown, in the clockwise direction in FIG. 1. The belt roller 51 is a driven roller rotated in the clockwise direction in FIG. 1 with rotation of the sheet-feed belt 53 by the rotation of the belt roller 52. Further, the tension roller 55 is rotatably supported by the casing 1*a* in a state in which the tension roller 55 applies tension to the sheet-feed belt 53 while contacting an inner surface of a lower portion of the sheet-feed belt 53. The tension roller 55 is rotated in the clockwise direction in FIG. 1 with the rotation of the sheet-feed belt 53. The platen 61 is formed to have a length slightly longer than that of each of the sheets P and the sheet-feed belt 53 in the main scanning direction.

Further, an upper surface of the platen 61 contacts an inner surface of an upper portion of the sheet-feed belt 53 and thereby supports the sheet-feed belt 53 from the inner surface thereof. Thus, the sheet-feed surface 54 of the upper portion of the sheet-feed belt 53 and the respective ink-ejection surfaces 2*a* of the ink-jet heads 2 are parallel to each other while facing each other, and a small space is formed between the ink-ejection surfaces 2*a* and the sheet-feed surface 54 of the sheet-feed belt 53. This space partly constitutes the sheet-feed path.

A pressing roller 48 is disposed on an upstream side of one of the ink-jet heads 2 which is disposed at the most upstream side in the sheet-feed direction A among the four ink-jet heads 2 and at a position facing the belt roller 51. The pressing roller 48 is biased or forced to the sheet-feed surface 54 by an elastic material such as a spring, not shown, and presses onto the sheet-feed surface 54 the sheet P supplied from the sheet-supply device 10. Further, the pressing roller 48 is a driven roller rotated with the rotation of the sheet-feed belt 53.

Further, a pressing roller 49 is disposed at a position which is located on an upstream side of the ink-jet head 2 disposed at the most upstream side in the sheet-feed direction A, which is located on a downstream side of the pressing roller 48, and which faces the platen 61. The pressing roller 49 is biased or forced to the sheet-feed surface 54 by an elastic material such as a spring, not shown, and presses the sheet P onto a position facing a predetermined position of the sheet-feed surface 54, thereby indirectly pressing the sheet P onto the platen 61. As a result, the sheet P is easily electrically adsorbed by a pair of comb-like electrodes 62*a*, 62*b* which will be described below. Further, the pressing roller 49 is a driven roller rotated with the rotation of the sheet-feed belt 53.

Further, the pair of comb-like electrodes 62*a*, 62*b* are provided on the upper surface of the platen 61. The upper surface is coated by a protective layer for protecting the upper surface from wear caused by contact with the sheet-feed belt 53. Each of the pair of comb-like electrodes 62*a*, 62*b* is provided in the sheet-feed direction A and includes a plurality of electrodes (i.e., parallel electrode portions) provided continuously to one another in the main scanning direction. Electrodes of one of the comb-like electrodes 62*a*, 62*b* and electrodes of the other are alternately arranged in the main scanning direction. Then, when a voltage is applied to a position between the pair of comb-like electrodes 62*a*, 62*b* by a power source, not shown, adjacent ones of the electrodes constitute a condenser (i.e., a capacitor) routing (a) a clearance between the electrodes and the sheet-feed belt 53, (b) the sheet-feed belt 53, (c) a clearance between the sheet-feed belt 53 and the sheet P, and (d) the sheet P. Further, a minute current which charges the condenser flows through the adjacent electrodes, thereby generating an electric field. As a result, a Johnsen-Rahbeck force (i.e., an adhesion force) is generated between the sheet P and the electrodes. This adhesion force causes the sheet P on the sheet-feed belt 53 to be electrically adsorbed to the sheet-feed surface 54. It is noted that the power source which applies the voltage to the position between the pair of comb-like electrodes 62*a*, 62*b* is controlled by the controller 100.

In this construction, the sheet-feed belt 53 is rotated by the control of the controller 100 in which the belt roller 52 is rotated in the clockwise direction in FIG. 1. In this time, the belt roller 51, the tension roller 55, the pressing roller 48, and the pressing roller 49 are also rotated with the rotation of the sheet-feed belt 53. Further, in this time, the voltage is applied to the position between the pair of comb-like electrodes 62*a*, 62*b* by the control of the controller 100, whereby the minute current which charges the condenser flows through the adjacent electrodes, and the Johnsen-Rahbeck force is generated. As a result, the sheet P supplied from the sheet-supply device 10 is fed in the sheet-feed direction A while being electrically adsorbed to the sheet-feed surface 54. Further, in this time, when the sheet P fed while being held on the sheet-feed surface 54 of the sheet-feed belt 53 passes through just below the four ink-jet heads 2, the controller 100 controls the ink-jet heads 2 such that the inks of the four colors are ejected onto the sheet P. As a result, a desired color image is formed on the sheet P.

Further, two sensors 71, 72 are provided between the pressing roller 48 and the ink-jet heads 2 and on a downstream side of one of the ink-jet heads 2 which is disposed at the most downstream side in the sheet-feed direction A among the four ink-jet heads 2. Detection surfaces of the respective sensors 71, 72 face the sheet-feed surface 54. Each of the sensors 71, 72 is a reflective optical sensor which detects the sheet P by reflection of a light on a surface of the sheet P. The sensors 71, 72 are respectively disposed at positions facing a center of the sheet-feed surface 54 in the main scanning direction. Each of the sensors 71, 72 detects a leading end of the sheet P fed by the sheet-feed belt 53. It is noted that each of the sensors 71, 72 is not limited to the reflective optical sensor and may be a transmission-type optical sensor, for example.

As shown in FIG. 1, a peeling plate 9 is provided just on a downstream side of the sheet-feed mechanism 50 in the sheet-feed direction A. The peeling plate 9 peels the sheet P from the sheet-feed surface 54 by entering of a distal end of the peeling plate 9 into a position between the sheet P and the sheet-feed belt 53.

Between the sheet-feed mechanism 50 and the sheet-discharge portion 15 along the sheet-feed path, there are disposed (a) four sheet-feed rollers 21*a*, 21*b*, 22*a*, 22*b* and (b) a sheet-discharge guide 18 disposed between the sheet-feed rollers 21*a*, 21*b* and the sheet-feed rollers 22*a*, 22*b*. The sheet-feed rollers 21*b*, 22*b* are driven to be rotated by a sheet-feed motor, not shown, controlled by the controller 100. Further, the sheet-feed rollers 21*a*, 22*a* are driven rollers rotated with the feeding of the sheet P.

In this construction, the controller 100 causes the sheet-feed motor to be driven such that the sheet-feed rollers 21*b*, 22*b* are rotated, whereby the sheet P fed by the sheet-feed mechanism 50 is fed through the sheet-discharge guide 18 toward an upper portion of the printer 1 in FIG. 1 while being held by the sheet-feed rollers 21*a*, 21*b*. Then, the sheet P is discharged to the sheet-discharge portion 15 while being held by the sheet-feed rollers 22*a*, 22*b*.

Figure 2A:
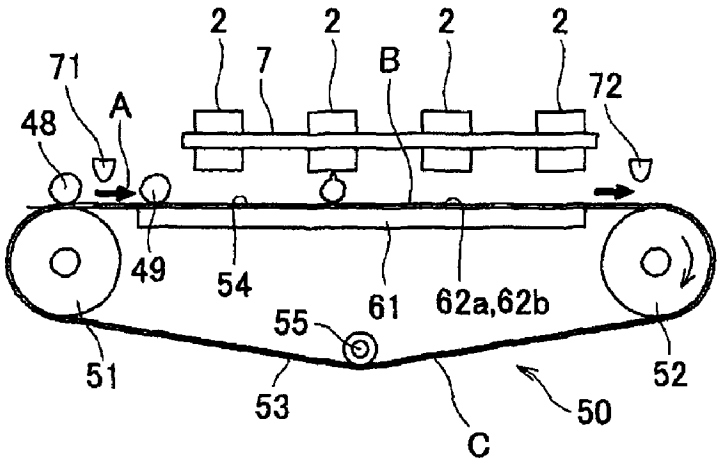
FIGS. 2A and 2B are views for explaining a flushing.
Figure 2B:
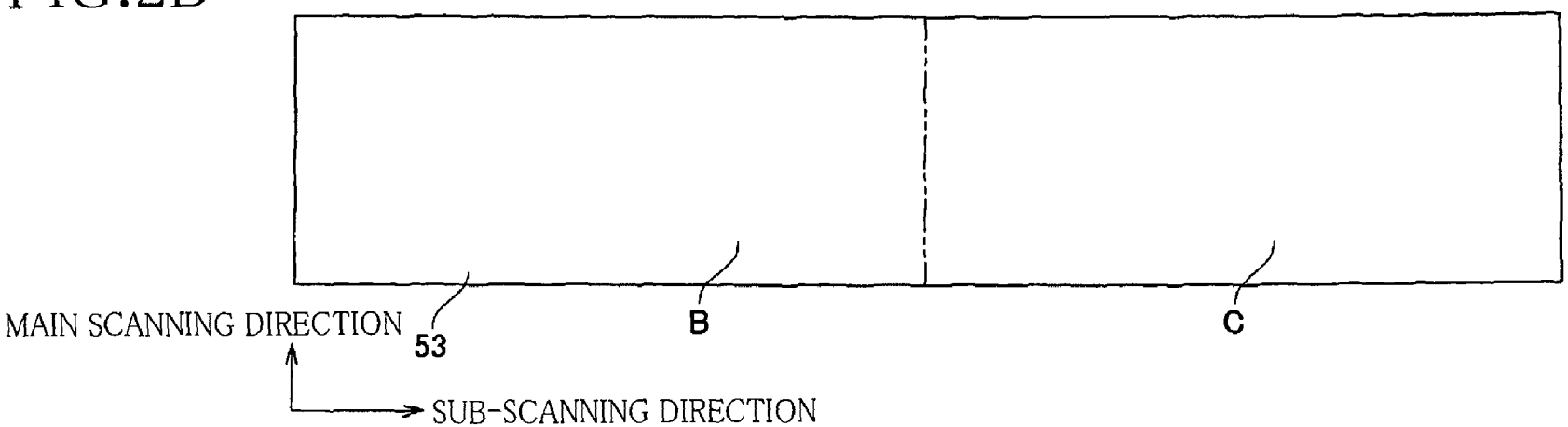

Further, a flushing in which the ink is ejected all the ink-ejection openings of the ink-jet head 2 is performed at a predetermined timing. In the present embodiment, as shown in FIG. 2A, the flushing is performed by the ejection of the ink by one of the ink-jet heads 2 from all the ink-ejection openings toward the sheet-feed surface 54. Further, as shown in FIG. 2B, the surface of the sheet-feed belt 53 is partitioned in a direction (i.e., the main scanning direction) perpendicular to the sheet-feed direction A, that is, the surface of the sheet-feed belt 53 is divided into two areas in the sub-scanning direction by partitioning the sheet-feed belt 53 in the main scanning direction, whereby two areas B, C are defined on the surface of the sheet-feed belt 53. The flushing is performed by ejection of the ink only toward the area B (specific area) when the area B is functioning as a part of the sheet-feed surface 54. Each of the two areas B, C is a fixed area on the outer surface of the sheet-feed belt 53. A length of the area B in the sheet-feed direction A is generally the same as that of the sheet P. Here, the predetermined timing at which the flushing is performed is a timing at which the area B is functioning as a part of the sheet-feed surface 54 and at which the sheet P is not located on the area B. Further, whether the area B is functioning as a part of the sheet-feed surface 54 or not is judged by operations in which a sensor, not shown, reads an alignment mark put on, e.g., a boundary of the two areas B, C, and in which an encoder provided on the sheet-feed motor that rotates the belt roller 52 detects an area of the sheet-feed belt 53 which is functioning as a part of the sheet-feed surface 54, for example. In FIG. 2A, the ink is ejected toward the area B functioning as a part of the sheet-feed surface 54 from a second one of the ink-jet heads 2 from the upstream side in the sheet-feed direction A. It is noted that three or more areas may be defined on the sheet surface of the sheet-feed belt 53.

It is noted that an order has been set for the four ink-jet heads 2 in advance, and one of the four ink-jet heads 2 ejects the corresponding ink from all the corresponding ink-ejection openings at each predetermined timing in the predetermined order, whereby the flushing is performed in all the ink-jet heads 2. As a result, since each of the four ink-jet heads 2 is equally given an opportunity of performing the flushing, it is possible to reduce a risk that, where one of the ink-jet heads 2 has less opportunities of performing the flushing than the other of the ink-jet heads 2, the ink dries in the ink-jet head 2 having less opportunities of performing the flushing.

After the flushing has been performed, the sheet-feed belt 53 is rotated, and the area B is moved to be positioned on the lower portion of the sheet-feed belt 53. Then, where the sheet-feed belt 53 is continued to be rotated, the area B is moved again to be positioned on the upper portion of the sheet-feed belt 53, that is, the area B functions as a part of the sheet-feed surface 54. Here, when the area B functions as a part of the sheet-feed surface 54, the sheet P is fed so as to be placed on the sheet-feed surface 54. Thus, the area B to be made to function as a part of the sheet-feed surface 54 contacts a back surface of the sheet P. As a result, the ink ejected toward the area B is absorbed into the back surface of the sheet P. That is, the sheet P is fed such that the sheet P overlaps with the area B, and the ink having been ejected toward the area B is absorbed into the back surface of the sheet P. While the sheet P passes through under the four ink-jet heads 2, the desired color image is formed on a front surface of the sheet P by the inks ejected from the respective four ink-jet heads 2. That is, the controller 100 can be considered to perform (i) a first control in which the ink is ejected directly onto the sheet-feed surface 54 and (ii) a second control in which the sheet P is, after the first control, supplied from the sheet-supply device 10 to the sheet-feed mechanism 50 and fed by the sheet-feed mechanism 50 while receiving the ink ejected from the ink-jet heads 2 such that the sheet P absorbs the ink on the sheet-feed surface 54 which has been ejected from the ink-jet head 2 in the first control.

Here, an amount of the ink ejected toward the area B in the flushing is an amount in which the ink is not easily noticed by a user even where the ink is absorbed into the back surface of the sheet P. Thus, even where the ink in the flushing is absorbed into the back surface of the sheet P, the sheet P is not wasted but used by the user without any problem.

As thus described, the ink ejected in the flushing is absorbed into the sheet P, thereby eliminating a need of a cleaning mechanism for cleaning the sheet-feed surface 54. Consequently, the flushing can be performed at a lower cost and in a smaller space.

Further, the ink is ejected by one of the plurality of the ink-jet heads 2, whereby only the corresponding ink is absorbed into the sheet P. As a result, when the ink has been absorbed into the sheet P, it is possible to restrain that the inks of the plurality of colors are mixed and easily noticed by the user.

Further, where the ink is ejected toward the area B in the flushing, and the sheet P is fed at a timing at which the sheet P overlaps with the area B, the ink is reliably absorbed into the sheet P. On the other hand, where the area toward which the ink is ejected in the flushing is not set, there is a need that, in each of the flushing, an area toward which the ink has been ejected is specified by, e.g., the sensor configured to read the alignment mark and/or the encoder configured to detect the area of the sheet-feed belt 53 which is functioning as a part of the sheet-feed surface 54, and the sheet P is fed so as to overlap with the area. Since the area toward which the ink is ejected in the flushing is set to the area B in the present embodiment, it is possible to eliminate a need of specifying which area the ink has been ejected toward. Further, a length of time required for the flushing can be made shorter as compared with the case where the flushing is performed after the sheet-feed belt 53 or the ink-jet heads 2 is moved upward or downward, and a receiving member is disposed under the ink-jet heads 2. Thus, the recording ability can be improved.

[Electric Construction of Ink-Jet Printer]

Figure 3:
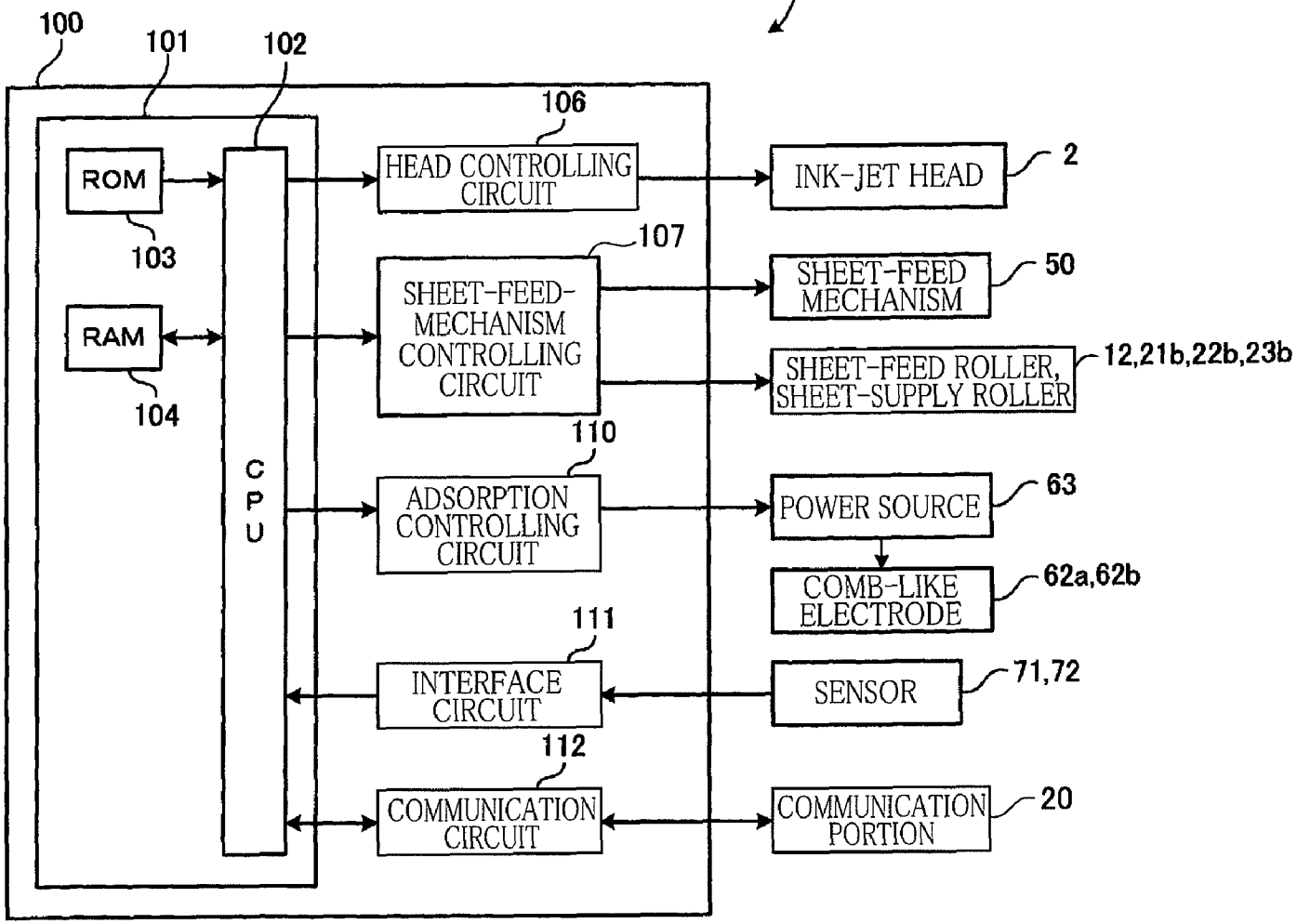
FIG. 3 is a view showing an electric construction of the ink-jet printer.

The ink-jet printer 1 is controlled by the controller 100 as shown in FIG. 3. The controller 100 includes (a) a microcomputer 101 as a main component disposed on a circuit board and (b) various circuits in addition to the microcomputer 101. The microcomputer 101 includes a Central Processing Unit (CPU) 102 configured to control the operations of the ink-jet printer 1 in accordance with predetermined programs, a Read Only Memory (ROM) 103 configured to store various programs, and a Random Access Memory (RAM) 104 as a temporary storage memory.

To the CPU 102, there are connected (a) a head controlling circuit 106 configured to control the ink-jet heads 2, (b) a sheet-feed-mechanism controlling circuit 107 configured to control the sheet-feed mechanism 50, the sheet-feed rollers 21*b*, 22*b*, 23*b*, and the sheet-supply roller 12, (c) an adsorption controlling circuit 110 configured to control a power source 63 which applies the voltage to positions between the pair of comb-like electrodes 62*a*, 62*b*, (d) an interface circuit 111 into which sheet detecting signals from the sensors 71, 72 are inputted, and (e) a communication circuit 112 configured to communicate with, e.g., a general-purpose personal computer, not shown, via a communication portion 20. The CPU 102 controls these circuits. The CPU 102, the head controlling circuit 106, and the sheet-feed-mechanism controlling circuit 107 constitute a controller.

The head controlling circuit 106 controls each ink-jet head 2 such that the head 2 ejects the ink toward the sheet P on the basis of recording data transferred from, e.g., the general-purpose personal computer, not shown, via the communication portion 20. In this time, the head controlling circuit 106 controls each ink-jet head 2 such that the ejection of the ink toward the sheet P is started when a first predetermined length of time has passed after the sensor 71 has detected the leading end of the sheet P fed by the sheet-feed mechanism 50. This first predetermined length of time is a time obtained by dividing, by a feeding speed of the sheet P, a distance along the sheet-feed path from the leading end of the sheet P at the time when the sensor 71 has detected the leading end to the most upstream one of the ink-ejection openings of the most upstream ink-jet head 2.

Further, the head controlling circuit 106 controls any of the ink-jet heads 2 such that the ink-jet head 2 ejects the ink toward the area B at the predetermined timing at which the area B is functioning as a part of the sheet-feed surface 54, and at which the sheet P is not located on the area B.

Further, the sheet-feed-mechanism controlling circuit 107 controls the sheet-feed mechanism 50, the sheet-feed rollers 21*b*, 22*b*, 23*b*, and the sheet-supply roller 12 such that the sheet P is fed from the sheet-supply device 10 to the sheet-discharge portion 15. Further, the sheet-feed-mechanism controlling circuit 107 controls the sheet-feed mechanism 50, the sheet-feed roller 23*b*, and the sheet-supply roller 12 such that the ink on the area B is absorbed into the back surface of the sheet P by overlapping of the sheet P with the area B after the flushing has been performed.

Further, the adsorption controlling circuit 110 controls the power source 63 such that the power source 63 applies the voltage to the positions between the pair of comb-like electrodes 62*a*, 62*b*.

[Flushing Processing]

There will be explained a flushing processing of the ink-jet printer 1 with reference to a flow-chart in FIG. 4.

Figure 4:
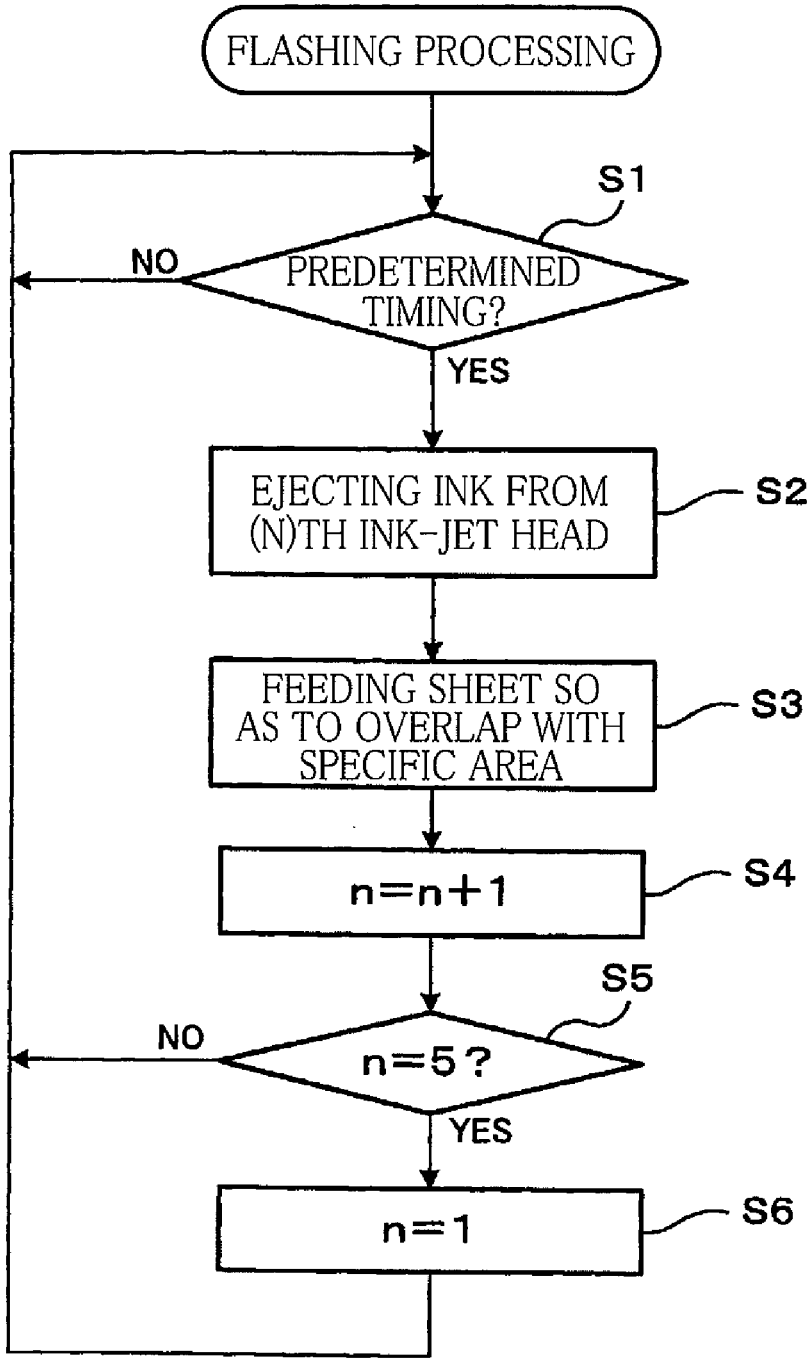
FIG. 4 is a flow-chart showing a flushing processing in the first embodiment.

In the flushing processing shown in FIG. 4, the CPU 102 judges in S1 whether a current time is the predetermined timing (at which the area B is functioning as a part of the sheet-feed surface 54, and at which the sheet P is not located on the area B) or not. Where the CPU 102 has judged that the current time is not the predetermined timing, this flushing processing returns to S1. On the other hand, where the CPU 102 has judged that the current time is the predetermined timing, the flushing is performed in S2 by the ejection of the ink toward the area B from all the ink-ejection openings of (n)th ink-jet head 2. Then, in S3, the sheet P is fed so as to overlap with the area B. As a result, the ink on the area B is absorbed into the back surface of the sheet P.

As thus described, the ink ejected in the flushing is absorbed into the sheet P, thereby eliminating the need of the cleaning mechanism for cleaning the sheet-feed surface 54. Consequently, the flushing can be performed at the lower cost and in the smaller space.

Further, the ink is ejected by one of the plurality of the ink-jet heads 2, whereby only the corresponding ink is absorbed into the sheet P. As a result, when the ink has been absorbed into the sheet P, it is possible to restrain that the inks of the plurality of colors are mixed and easily noticed by the user.

Further, where the ink is ejected toward the area B, and the sheet P is fed at the timing at which the sheet P overlaps with the area B, the ink is reliably absorbed into the sheet P. Thus, it is possible to eliminate a need of specifying the area to which the ink has been ejected in each flushing by calculation, for example. Further, since it has been determined that the ink ejected from the ink-jet head 2 in the flushing is attached onto the area B, each sheet P may be supplied onto the sheet-feed belt 53 by the sheet-supply roller 12 at a timing the same as a timing when the sheet P is placed onto the area B. That is, there is no need to control a drive starting timing of the sheet-supply roller 12 for each sheet P. In contrast, in the case where a position onto which the ink ejected from the ink-jet head 2 is attached in the flushing has not been determined, there is a need that the drive starting timing of the sheet-supply roller 12 is controlled for each sheet in correspondence with the position onto which the ink is attached, such that the sheet P absorbs the ink attached onto the sheet-feed belt 53 in the flushing.

After the processing of S3, the CPU 102 adds one to the variable "n" in S4. Then, in S5, the CPU 102 judges whether the variable "n" is five or not. Whether the CPU 102 has judged that the variable "n" is not five, this flushing processing returns to S1. As a result, when the predetermined timing has reached next, the flushing is performed by the ejection of the ink toward the area B from the ink-jet head 2 which is different from one which has previously performed the ejection in the flushing. On the other hand, where the CPU 102 has judged that the variable "n" is five, the CPU 102 sets in S6 the variable "n" to one, and this flushing processing returns to S1. As a result, the four ink-jet heads 2 perform the flushing in order.

<Second Embodiment>

[Mechanical Construction of Ink-Jet Printer]

Figure 5:
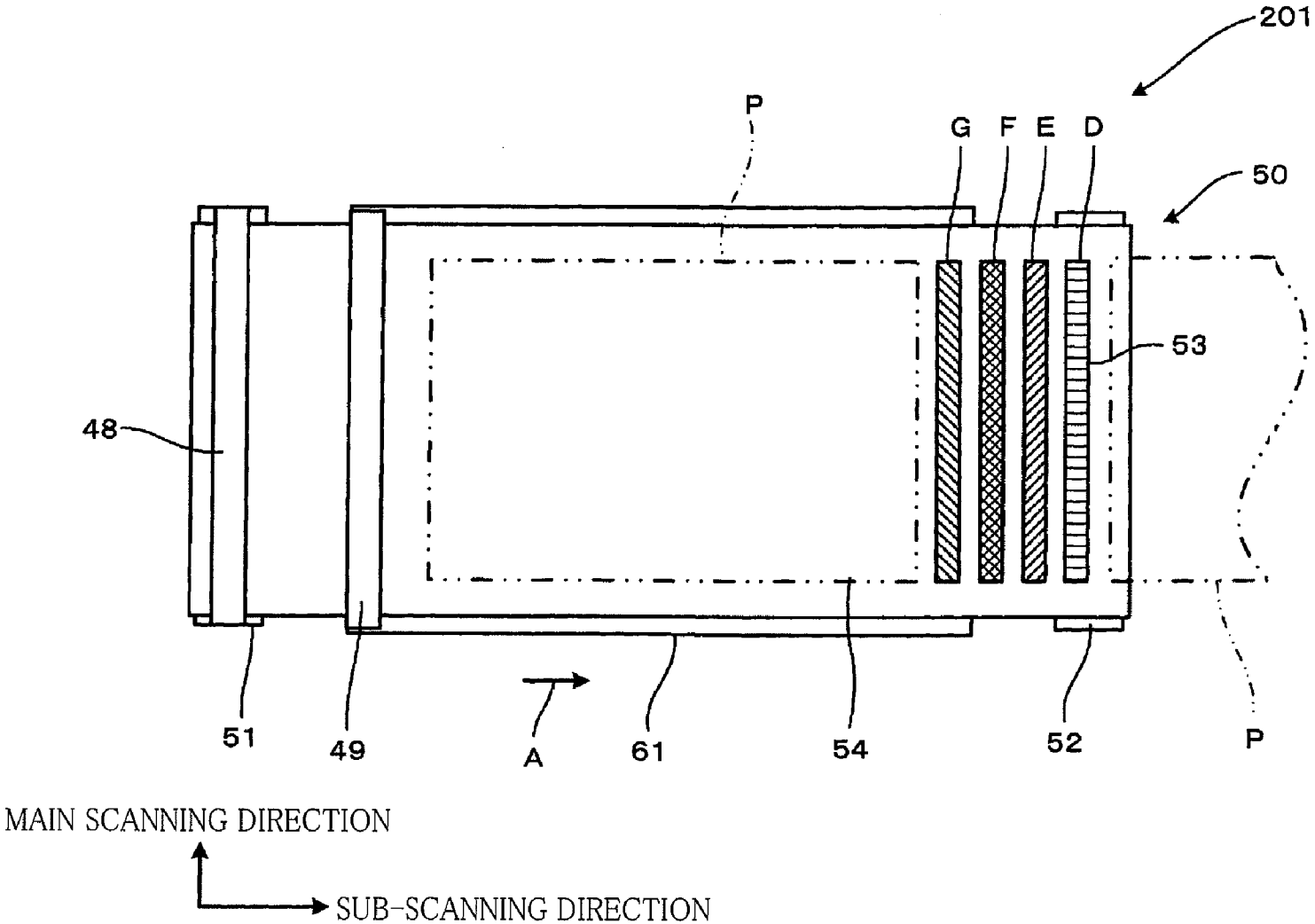
FIG. 5 is a plan view of a sheet-feed mechanism of an ink-jet printer as a second embodiment of the present invention as seen from an upper side of the sheet-feed mechanism.

There will be next an ink-jet printer 201 as a second embodiment of the present invention. The ink-jet printer 201 as the second embodiment is different from the ink-jet printer 1 as the first embodiment in that, as shown in FIG. 5, the flushing is performed by the ejection of the respective inks by the four ink-jet heads 2 toward areas D, E, F, G of the sheet-feed surface 54 which are different from each other in the sheet-feed direction A. The four areas D, E, F, G are provided not at fixed positions on the outer surface of the sheet-feed belt 53, but at any positions between two sheets P successively placed on the sheet-feed surface 54. A distance between the two sheets P is determined so as to be larger than a total distance of the four areas D, E, F, G in the sheet-feed direction A.

Specifically, as shown in FIG. 5, between the two sheets P being fed, the ink is ejected toward the area D from all the ink-ejection openings of one of the ink-jet heads 2 which is located at the most upstream side in the sheet-feed direction A, at a timing when the area D is located just under the most upstream ink-jet head 2, then the ink is ejected toward the area E from all the ink-ejection openings of a second one of the ink-jet heads 2 from the most upstream side in the sheet-feed direction A, at a timing when the area E is located just under the second ink-jet head 2, then the ink is ejected toward the area F from all the ink-ejection openings of a third one of the ink-jet heads 2 from the most upstream side in the sheet-feed direction A, at a timing when the area F is located just under the third ink-jet head 2, and then the ink is ejected toward the area G from all the ink-ejection openings of one of the ink-jet heads 2 which is located at the most downstream side in the sheet-feed direction A, at a timing when the area G is located just under the most downstream ink-jet head 2.

Here, in the flushing, the four areas D, E, F, G are initially set between the two sheets P being fed, and then the inks are respectively ejected to the areas D, E, F, G. Thus, the flushing is performed without waiting the timing at which the area B functions as a part of the sheet-feed surface 54 and at which the sheet P is not located on the area B like the first embodiment. The controller 100 specifies the space between the two sheets P being fed, on the basis of the leading end of the sheet P which has been detected by the sensors 71, 72, the size of the sheet P in the sheet-feed direction A, and so on, for example. Then, the controller 100 controls each ink-jet head 2 such that the ink-jet head 2 ejects the ink from all the ink-ejection openings thereof toward the corresponding area at a timing at which a second predetermined length of time has passed. This second predetermined length of time is a time obtained by dividing, by the feeding speed of the sheet P, a distance along the sheet-feed path from a position of one of the four areas D, E, F, G when the sensor 71 has detected a leading end of an upstream one of the two sheets P to the most upstream one of the ink-ejection openings of one of the ink-jet heads 2 which corresponds the one of the areas D, E, F, G. For example, the controller 100 controls the most upstream ink-jet head 2 such that the ink-jet head 2 ejects the ink toward the area D from all the ink-ejection openings thereof at a timing at which the second predetermined length of time has passed which is obtained by dividing, by the feeding speed of the sheet P, a distance along the sheet-feed path from a position of the area D when the sensor 71 has detected the leading end of the upstream one of the two sheets P to the most upstream one of the ink-ejection openings of the most upstream ink-jet head 2.

After the flushing has been performed, the sheet-feed belt 53 is rotated, and each of the areas D, E, F, G is moved to be positioned on the lower portion of the sheet-feed belt 53. Then, where the sheet-feed belt 53 is continued to be rotated, each of the areas D, E, F, G is moved again to be positioned on the upper portion of the sheet-feed belt 53, that is, the area B functions as a part of the sheet-feed surface 54. Here, when or before each of the areas D, E, F, G functions as a part of the sheet-feed surface 54, the sheet P is fed onto the sheet-feed surface 54. Thus, each of the areas D, E, F, G made to function as a part of the sheet-feed surface 54 contacts the back surface of the sheet P. As a result, the inks of four colors respectively ejected toward the areas D, E, F, G are absorbed into the back surface of the sheet P. That is, the sheet P is fed such that the sheet P overlaps with the areas D, E, F, G, and the respective inks being ejected toward the areas D, E, F, G are absorbed into the back surface of the sheet P. While the sheet P passes through under the four ink-jet heads 2, the desired color image is formed on the front surface of the sheet P by the inks ejected from the respective four ink-jet heads 2.

As thus described, the four ink-jet heads 2 respectively eject the inks toward the areas D, E, F, G of the sheet-feed surface 54 which are different from each other in the sheet-feed direction A, whereby the inks of different colors are respectively absorbed into a plurality of areas of the sheet P. As a result, it is possible to restrain that, when the inks are absorbed into the sheet P, the inks of different colors are mixed and thus easily noticed by the user.

The other constructions are the same as those in the first embodiment, and thus an explanation thereof is dispensed with.

[Flushing Processing]

There will be explained a flushing processing of the ink-jet printer 201 with reference to a flow-chart in FIG. 6.

Figure 6:
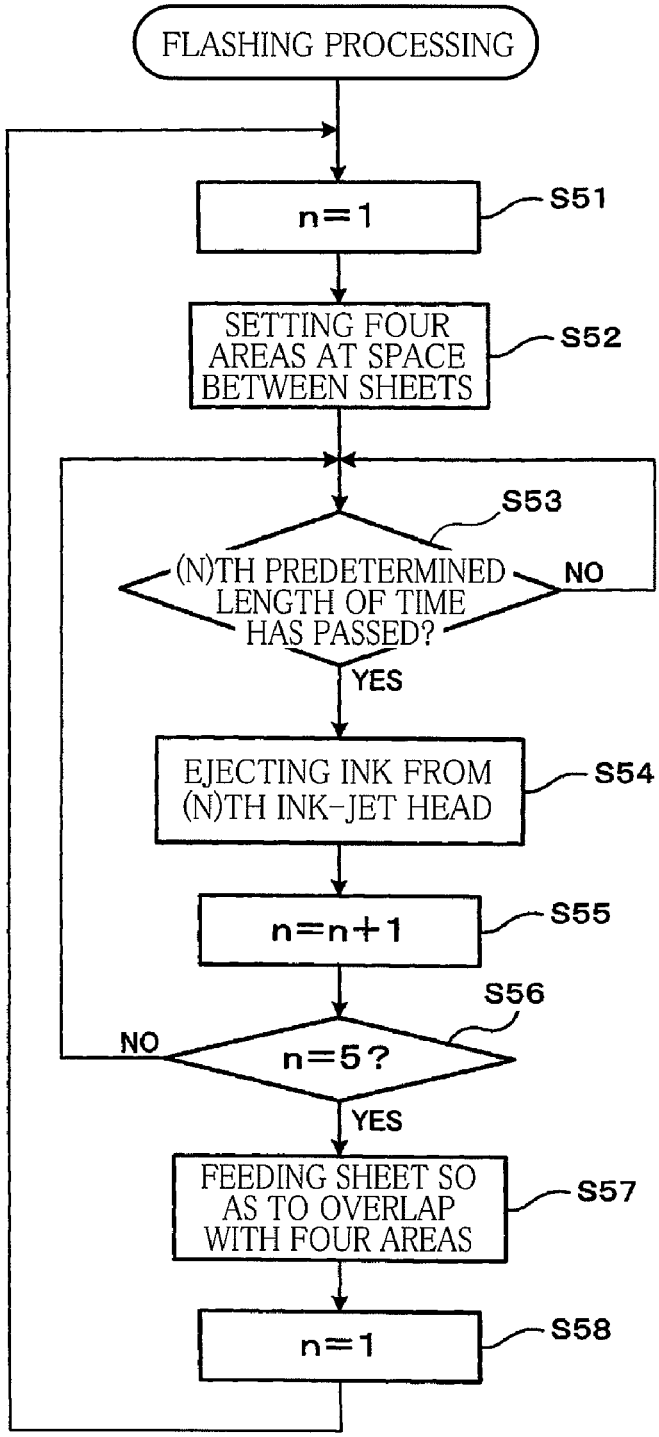
FIG. 6 is a flow-chart showing a flushing processing in the second embodiment.

In the flushing processing shown in FIG. 6, the CPU 102 sets in S51 the variable "n" to one. It is noted that the most upstream ink-jet head 2 is a first ink-jet head (n=1), the second ink-jet head 2 from the most upstream side is a second ink-jet head (n=2), the third ink-jet head 2 from the most upstream side is a third ink-jet head (n=3), and the most downstream ink-jet head 2 is a fourth ink-jet head (n=4). Then, in S52, the CPU 102 specifies the space between the two sheets P on the basis of the leading end of the sheet P which has been detected by the sensors 71, 72, the size of the sheet P in the sheet-feed direction A, and so on, for example, and sets the four areas D, E, F, G in this space. Then, in S53, the CPU 102 judges whether (n)th predetermined second length of time has passed or not. Here, the (n)th predetermined second length of time is a time obtained by dividing, by the feeding speed of the sheet P, a distance along the sheet-feed path from a position of one of the four areas D, E, F, G which corresponds to (n)th one of the ink-jet heads 2 when the sensor 71 has detected the leading end of the upstream one of the two sheets P to the most upstream one of the ink-ejection openings of the (n)th ink-jet head 2.

Where the CPU 102 has judged that the predetermined second length of time has not passed (S53: NO), the processing of S53 is repeated. On the other hand, where the CPU 102 has judged that the predetermined second length of time has passed (S53: YES), the flushing is performed in S54 by the ejection of the ink from all the ink-ejection openings of the (n)th ink-jet head 2.

Then, in S55, the CPU 102 adds one to the variable "n". Then, in S56, the CPU 102 judges whether the variable "n" is five or not. Where the CPU 102 has judged that the variable "n" is not five (S56: NO), this flushing processing returns to S53. As a result, the ink is ejected from the next one of the ink-jet heads 2 toward a corresponding one of the areas D, E, F, G. By repeating the processings of S53-S56, the flushing is performed in all the four ink-jet heads 2. On the other hand, where the variable "n" is five (S56: YES), the sheet P is fed in S57 so as to overlap with the four areas D, E, F, G. As a result, the inks of respective four colors on the respective four areas D, E, F, G are absorbed into the back surface of the sheet P. As thus described, the four ink-jet heads 2 respectively eject the inks toward the areas D, E, F, G of the sheet-feed surface 54 which are different from each other in the sheet-feed direction A, whereby the inks of different colors are respectively absorbed into a plurality of areas of the sheet P. As a result, it is possible to restrain that, when the inks are absorbed into the sheet P, the inks of different colors are mixed and thus easily noticed by the user.

After the processing of S57, the CPU 102 sets in S58 the variable "n" to one, this flushing processing returns to S1.

<Modification of the Present Embodiments>

While the embodiments of the present invention have been described above, it is to be understood that the invention is not limited to the details of the illustrated embodiments, but may be embodied with various changes and modifications, which may occur to those skilled in the art, without departing from the spirit and scope of the invention. Further, while the most preferable operations and effects of the present invention have been described in the illustrated embodiments, operations and effects of the present inventions are not limited to those described in the illustrated embodiments.

For example, in the above-described embodiments, the inks ejected in the flushing are absorbed into the back surface of the sheet P, but the ink-jet printer to which the present invention is applied may further include a cleaning roller configured to contact the outer surface (i.e., the front surface) of the lower portion of the sheet-feed belt 53 so as to absorb the ink which has not been absorbed into the back surface of the sheet P. Further, the cleaning roller may be configured such that the cleaning roller is normally distant from the outer surface of the lower portion of the sheet-feed belt 53, and, for example, contacts the outer surface of the lower portion of the sheet-feed belt 53 each time when the flushing has been performed totally fifty times. In this configuration, a frequency of usage of the cleaning roller can be reduced, thereby increasing the service life of the cleaning roller.

Further, in the above-described embodiments, the ink-jet printer to which the present invention is applied may further include a pressing roller disposed on a downstream side of the one of the ink-jet heads 2 which is located at the most downstream side in the sheet-feed direction A and at a position facing the belt roller 52. Like the pressing roller 48, this pressing roller is biased or forced to the sheet-feed surface 54 by an elastic material such as a spring and rotated with the rotation of the sheet-feed belt 53. Then, this pressing roller presses onto the sheet-feed surface 54 the sheet P fed from the sheet-feed mechanism 50 toward the sheet-discharge guide 18. As a result, even where jamming of the sheets P has occurred in the sheet-discharge guide 18, for example, the image recording performed on the sheet-feed surface 54 can be less affected. On the other hand, where the flushing has been performed, this pressing roller is moved away from the sheet-feed surface 54 such that the ink on the sheet-feed belt 53 does not adhere to the pressing roller, at a timing when an area to which the ink is ejected is positioned at a position facing the pressing roller.

Further, in the above-described first embodiment, the ink-jet printer 1 is configured such that only the ink corresponding to any one of the ink-jet heads 2 is ejected onto the area B, but the present invention is not limited to this configuration. For example, the ink-jet printer 1 may be configured such that the inks respectively corresponding to any two of the ink-jet heads 2 are ejected onto the area B. In the case where the inks respectively corresponding to all the ink-jet heads 2 are ejected onto the area B, the inks of the plurality of colors are mixed and easily noticed by the user when the inks are absorbed into the sheet P. However, even in the case where the mixed inks of magenta and cyan are absorbed into the sheet P, for example, these inks can be ejected onto the area B where the inks to be absorbed are not easily noticed.

Further, in the above-described second embodiment, the ink-jet printer 1 is configured such that the four ink-jet heads 2 respectively eject the inks toward the areas D, E, F, G provided on the sheet-feed surface 54 at different areas from each other in the sheet-feed direction A, but the present invention is not limited to this configuration. For example, the ink-jet printer 1 may be configured such that the inks respectively corresponding to any two of the four ink-jet heads 2 are ejected onto the same area. In the case where the respective inks of all the four ink-jet heads 2 are ejected onto the same area, the inks are mixed and easily noticed when the inks are absorbed into the sheet P. However, even in the case where the mixed inks of magenta and cyan are absorbed into the sheet P, for example, these inks can be ejected onto the same area where the inks to be absorbed are not easily noticed.

Further, in the above-described second embodiment, the ink-jet printer 1 is configured such that the four areas D, E, F, G are provided at any positions between two sheets P successively placed on the sheet-feed surface 54, but the present invention is not limited to this configuration. For example, the ink-jet printer 1 may be configured such that the four areas are provided on the area B described in the first embodiment. That is, the ink-jet printer 1 may be configured such that the four areas located at the different areas from each other in the sheet-feed direction A are provided on the area B on the sheet-feed surface 54, and the inks respectively corresponding to the four ink-jet heads 2 are respectively ejected on the four areas. Where the ink-jet printer 1 is thus configured, the flushing can be performed for the four ink-jet heads 2 during one pass-through of the area B under the four ink-jet heads 2. Thus, the flushing can be performed for a relatively short time.

Further, in the above-described second embodiment, the ink-jet printer 1 is configured such that the four areas D, E, F, G are set as areas on the sheet-feed surface 54 which are different from each other in the sheet-feed direction A, but the present invention is not limited to this configuration. For example, where the present invention is applied to an ink-jet printer of serial type in which heads reciprocates, the four areas may be set as areas on the sheet-feed surface 54 which are different from each other in a direction perpendicular to the sheet-feed direction A. Where the ink-jet printer is thus configured, it becomes possible to arrange the four areas in the direction perpendicular to the sheet-feed direction A, thereby reducing a length in the sheet-feed direction A required for providing the four areas. As a result, even where a distance between successive two sheets P is small, that is, even where a length of the sheet-feed surface 54 for providing the four areas in the sheet-feed direction A is small, it becomes possible to provide the four areas on the sheet-feed surface 54, whereby the flushing can be performed regardless of the distance between the successive two sheets P.

Figure 7:
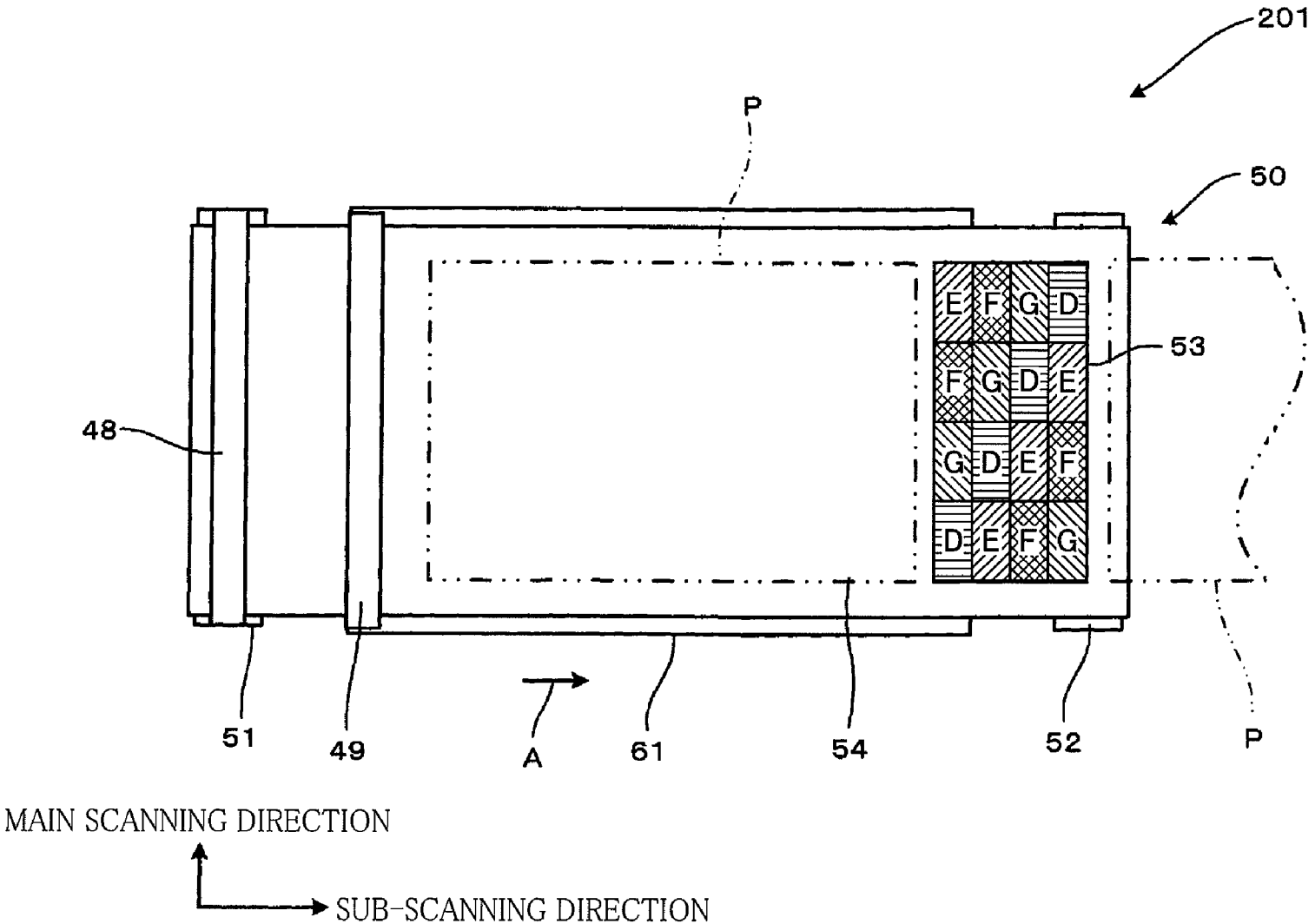
FIG. 7 is a plan view of a sheet-feed mechanism of an ink-jet printer as a modification of the second embodiment of the present invention as seen from an upper side of the sheet-feed mechanism.

Further, in the above-described second embodiment, the ink-jet printer 1 is configured such that the four areas D, E, F, G are set as the areas which are different from each other in the sheet-feed direction A, but the present invention is not limited to this configuration. For example, where the present invention is applied to the ink-jet printer of the line type, the ink-jet printer 1 may be configured such that the four areas D, E, F, G are set as areas different from each other in the sheet-feed direction A and different from each other in the direction perpendicular to the sheet-feed direction A. FIG. 7 shows a sheet-feed mechanism 50 in which the areas D, E, F, G are thus set. As shown in FIG. 7, four areas D, E, F, G are set alternately in the sheet-feed direction A and in the direction perpendicular to the sheet-feed direction A on a region on the surface of the sheet-feed belt 53 of the sheet-feed mechanism 50 which region is located between two areas on which the fed sheets P are respectively located. Specifically, four areas D, four areas E, four areas F, and four areas G are set as a total of sixteen areas. When the sixteen areas are seen in the sheet-feed direction A, one of the four areas D, one of the four areas E, one of the four areas F, and one of the four areas G are set in respective rows. Further, when the sixteen areas are seen in the direction perpendicular to the sheet-feed direction A, one of the four areas D, one of the four areas E, one of the four areas F, and one of the four areas G are set in respective rows, and positions of the four areas D, E, F, G in the direction perpendicular to the sheet-feed direction A are set at areas different from each other in each color. For example, in the case of the areas D, the areas D are respectively set at an uppermost area in a rightmost row in FIG. 7, at a second area from the uppermost area in a second row from the rightmost row in FIG. 7, at a third area from the uppermost area in a third row from the rightmost row in FIG. 7, and at a fourth area from the uppermost area in a fourth row from the rightmost row in FIG. 7. In the case where the four areas are set in this manner, when the inks of the different colors are ejected to the areas D, E, F, G, the inks of the different colors are absorbed in each of a plurality of the areas on the sheet P. As a result, it is possible to restrain that the inks of the plurality of colors are mixed and easily noticed by the user when the inks have been absorbed into the sheet P. Further, positions of each of the four areas D, E, F, G in the direction perpendicular to the sheet-feed direction A are different from each other, thereby making it possible to eject the inks from all the ink-ejection openings of the ink-jet head 2 in the direction perpendicular to the sheet-feed direction A when the flushing is performed by the ink-jet printer of the line type. This leads to an improvement of the performance of the flushing.

Further, in the above-described first embodiment, the ink-jet printer 1 is configured such that the length of the area B in the sheet-feed direction A is generally the same as that of the sheet P, but the present invention is not limited to this configuration. For example, the ink-jet printer 1 may be configured such that the length of the area B in the sheet-feed direction A is made a length larger than the length of the sheet P and smaller than twice the length thereof (e.g., one and half times the length thereof), and the sheet P is placed on the area B. Also in the case where the ink-jet printer 1 is thus configured, the ink ejected onto the area B may be absorbed into the sheet P. Further, where the ink-jet printer 1 is configured such that the length of the area B in the sheet-feed direction A is made the above-described length, and the ink is ejected only onto a generally central portion of the area B in the sheet-feed direction A, the sheet P is placed onto the generally central portion of the area B in the sheet-feed direction A, thereby reliably absorbing the ink ejected on the area B.

The application of the present invention is not limited to the recording apparatus of the ink-jet type, but the present invention can be applied to a recording apparatus of thermal type. Further, the application of the present invention is not limited to the recording apparatus of the line type, but the present invention can also be applied to a recording apparatus of serial type in which the ink-jet heads 2 reciprocate. Further, the application of the present invention is not limited to the printer, but the present invention can also be applied to a facsimile machine, and a copying machine, and so on, for example. Further, in the above-described embodiments, the sheet-feed mechanism 50 feeds the sheet P in the horizontal direction, but the ink-jet printer to which the present invention is applied may be configured such that the sheet-feed surface 54 parallel to the ink-ejection surfaces 2*a* is inclined with respect to the horizontal direction such that the sheet P can be fed in a direction other than the horizontal direction (e.g., an oblique direction and a vertical direction).

What is claimed is:

1. An ink-jet recording apparatus comprising:

at least one ink-jet head having an ink-ejection surface from which an ink is ejected;

a feeding mechanism which includes a feeding member having a feeding surface facing the ink-ejection surface and which is configured to feed a recording medium on the feeding surface in a feeding direction in which the recording medium is fed;

a supplying mechanism configured to supply the recording medium to the feeding mechanism; and a controller configured to control operations of the at least one ink-jet head, the feeding mechanism, and the supplying mechanism, wherein the controller is configured to perform (i) a first control in which the ink is ejected directly onto the feeding surface and (ii) a second control in which the recording medium is, after the first control, supplied from the supplying mechanism to the feeding mechanism such that the recording medium absorbs the ink on the feeding surface that has been ejected from the at least one ink-jet head in the first control, and in which the recording medium is fed by the feeding mechanism during the ejection of the ink from the at least one ink-jet head onto the recording medium.

2. The ink-jet recording apparatus according to claim 1, wherein the at least one ink-jet head is configured to be capable of ejecting inks of a plurality of colors, and wherein the controller is configured to control the operation of the at least one ink-jet head in the first control such that the inks of not all the plurality of colors are ejected.

3. The ink-jet recording apparatus according to claim 2, wherein the controller is configured to control the operation of the at least one ink-jet head in the first control such that the ink of any only one of the plurality of colors is ejected.

4. The ink-jet recording apparatus according to claim 3, wherein the controller is configured to repeat a plurality of sets of the first control and the second control such that the first control is performed for each of the inks of all the plurality of colors.

5. The ink-jet recording apparatus according to claim 1, wherein the at least one ink-jet head is configured to be capable of ejecting inks of a plurality of colors, and wherein the controller is configured to control the operation of the at least one ink-jet head in the first control such that the inks of at least two of the plurality of colors are ejected respectively onto areas of the feeding surface whose respective positions are different from each other.

6. The ink-jet recording apparatus according to claim 5, wherein the controller is configured to control the operation of the at least one ink-jet head in the first control such that the ink of each of the plurality of colors is ejected onto a corresponding one of areas of the feeding surface whose respective positions are different from each other.

7. The ink-jet recording apparatus according to claim 1, wherein the controller is configured to control the operation of the at least one ink-jet head in the first control such that the ink is ejected only onto a specific area of a plurality of areas into which a surface of the feeding member is divided in the feeding direction, and wherein the controller is configured to control the operations of the supplying mechanism and the feeding mechanism in the second control such that the recording medium overlaps with the specific area.

8. The ink-jet recording apparatus according to claim 7, wherein the controller is configured to control the operations of the supplying mechanism and the feeding mechanism in the second control such that opposite end portions of the recording medium in the feeding direction are disposed within the specific area.

9. The ink-jet recording apparatus according to claim 8, wherein a length of the specific area in the feeding direction is generally the same as that of the recording medium in the feeding direction.

10. The ink-jet recording apparatus according to claim 7, wherein the specific area is located on the surface of the feeding member at a position between two recording media successively placed on the feeding surface.

11. The ink-jet recording apparatus according to claim 1, wherein the at least one ink-jet head has a plurality of ink-ejection openings formed in the ink-ejection surface, and wherein the controller is configured to control the operation of the at least one ink-jet head in the first control such that the ink is ejected from all the plurality of ink-ejection openings.

12. The ink-jet recording apparatus according to claim 1, wherein the controller is configured to control the operations of the supplying mechanism and the feeding mechanism in the second control such that the recording medium overlaps with an area of the feeding surface onto which area the ink has been ejected in the first control.

* * * * *